US007892652B2

(12) United States Patent
Strock et al.

(10) Patent No.: US 7,892,652 B2
(45) Date of Patent: Feb. 22, 2011

(54) LOW STRESS METALLIC BASED COATING

(75) Inventors: Christopher W. Strock, Kennebunk, ME (US); Richard M. Kabara, Cromwell, CT (US); Charles Davis, Sanford, ME (US)

(73) Assignee: United Technologies Corporation, Hartford, CT (US)

( * ) Notice: Subject to any disclaimer, the term of this patent is extended or adjusted under 35 U.S.C. 154(b) by 782 days.

(21) Appl. No.: 11/717,298

(22) Filed: Mar. 13, 2007

(65) Prior Publication Data

US 2008/0226879 A1 Sep. 18, 2008

(51) Int. Cl.
*B22F 7/04* (2006.01)
*B22F 7/00* (2006.01)

(52) U.S. Cl. ..... 428/553; 428/556; 428/557; 428/558; 428/621; 428/626; 428/627; 428/632; 416/241 R; 416/241 B; 106/1.05; 106/169.57; 106/169.56; 106/287.35; 106/676

(58) Field of Classification Search ..... None
See application file for complete search history.

(56) References Cited

U.S. PATENT DOCUMENTS

| | | | | |
|---|---|---|---|---|
| 4,109,031 | A | 8/1978 | Marscher | |
| 4,481,237 | A | 11/1984 | Bosshart et al. | |
| 4,485,179 | A * | 11/1984 | Brennan et al. | 501/32 |
| 4,503,130 | A | 3/1985 | Bosshart et al. | |
| 4,588,607 | A | 5/1986 | Matarese et al. | |
| 4,588,699 | A * | 5/1986 | Brennan et al. | 501/9 |
| 4,589,900 | A * | 5/1986 | Brennan et al. | 264/640 |
| 4,704,332 | A * | 11/1987 | Brennan et al. | 428/428 |
| 4,738,902 | A * | 4/1988 | Prewo et al. | 428/697 |
| 5,034,284 | A | 7/1991 | Bornstein et al. | |
| 5,439,627 | A * | 8/1995 | De Jager | 264/129 |
| 5,449,536 | A | 9/1995 | Funkhouser et al. | |
| 5,906,896 | A | 5/1999 | Jackson et al. | |
| 5,932,356 | A | 8/1999 | Sileo et al. | |
| 6,186,508 | B1 | 2/2001 | Zajchowski et al. | |
| 6,435,835 | B1 | 8/2002 | Allen et al. | |
| 6,815,099 | B1 | 11/2004 | Zajchowski et al. | |
| 6,919,042 | B2 | 7/2005 | Beers et al. | |
| 7,207,374 | B2 | 4/2007 | Persky et al. | |

FOREIGN PATENT DOCUMENTS

| | | | |
|---|---|---|---|
| EP | 0244343 | A2 | 11/1987 |
| EP | 1010861 | A2 | 6/2000 |
| WO | WO 2006007950 | A1 * | 1/2006 |

OTHER PUBLICATIONS

Greving et al., "Effects of Coating Thickness and Residual Stresses on the Bond Strength of ASTM C633-79 Thermal Spray Coating Test Specimens", The Journal of Thermal Spray Technology, vol. 3(4) Dec. 1994, pp. 371-378.

Pao et al., "Fatigue Crack Growth and Fracture Toughness in Biomodal A1 5083", Materials Research Society Symposium - Proc. vol. 791, 2004, XP-002602853.

The Nov. 12, 2010 European Search Report for Counterpart European Application No. 08250165.

* cited by examiner

*Primary Examiner*—Aaron Austin
(74) *Attorney, Agent, or Firm*—Kinney & Lange, P.A.

(57) ABSTRACT

A composition for deposition as a coating includes a matrix material having a molten fraction of between about 33% and about 90% by volume and a filler material interspersed within the matrix.

13 Claims, 1 Drawing Sheet

LOW STRESS METALLIC BASED COATING

STATEMENT REGARDING FEDERALLY SPONSORED RESEARCH OR DEVELOPMENT

This invention was made with the support of the United States Government under Contract No. N00019-02-C-3003 awarded by the United States Navy. The United States Government has certain rights in the invention.

BACKGROUND OF THE INVENTION

The present invention relates generally to the field of coatings. In particular, the present invention relates to low stress coatings.

Coatings are typically used on gas turbine engine components in order to protect the underlying component from degradation and wear. The coatings, such as abradable outer air seals for fan cases, are typically between approximately 0.15 inches and approximately 0.28 inches thick. At greater thicknesses, the coating may experience excessive tensile and compressive stresses which lead to cracking. Conventional spray technology for applying the coatings use standard plasma spray torches, such as the Sulzer-Metco 3MB, Sulzer-Metco F4, Triplex torches, or other similar designs. However, these spray techniques are designed for maximum particle heating and deposition efficiency. Another spray technique used is high velocity oxygen fuel spray (HVOF). One concern with HVOF for applying thick coatings is that the velocity may be too high, causing excessive compressive stress in the resulting coating.

A concern with current plasma and flame spraying techniques used in the art for applying coatings of this thickness is that they commonly produce a tensile stressed coating. The tensile stresses develop as the powder particles are deposited into the coating and are related to factors including, but not limited to: the kinetic energy of the particles, how much the particles have been melted (herein after referred to as the molten fraction), and the temperature of the component on which the coating is being applied. In addition, if the coating is applied too thickly, the tensile stress, which is inherent in the coating, results in loss of bond strength, cracking, and delamination due to the excess accumulation of tensile stress. The tensile stress may ultimately reduce the durability of the coating to the point where it may spontaneously delaminate during the manufacturing process. In addition, most application processes tend to distort the component on which the coating is applied.

It would thus be beneficial to develop a low tensile-stressed coating and a process of depositing the low tensile-stress coating.

BRIEF SUMMARY OF THE INVENTION

A composition for deposition as a coating includes a matrix material having a molten fraction of between about 33% and about 90% by volume and a filler material interspersed within the matrix.

DETAILED DESCRIPTION

Figure 1:
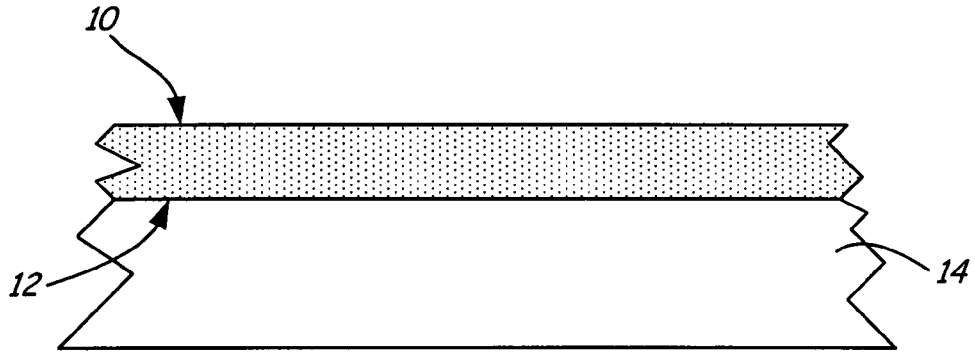
FIG. 1 is a cross-sectional view of a component having a reduced-tensile stress coating.

FIG. 1 shows a cross-sectional view of low tensile-stress coating 10 applied onto surface 12 of component 14. Low tensile-stress coating 10 is beneficial because as tensile stress in coating 10 increases, the bond strength of coating 10 decreases and causes deflection or bending of component 14. Deflection is caused primarily by accumulation of tensile stress in coating 10. The accumulation of excess tensile stress caused when coating 10 is built up too thick results in loss of bond strength, cracking, and delamination. Thus, as the thickness of coating 10 increases, the bond strength of coating 10 decreases. The bond strength of coating 10 decreases substantially linearly for thinner applications of coating 10. By selecting the proper spray parameters, coating 10 may be applied onto surface 12 to exhibit minimal to no spray-related tensile or compressive stresses. Coating 10 may be designed to exhibit low tensile stress by matching stress levels from the spray process with the stress that results from differential thermal expansion between coating 10 and component 14. This is achieved by balancing the thermal energy and kinetic energy of coating 10 as coating 10 is being sprayed onto component 14. In an exemplary embodiment, coating 10 is an abradable outer air seal of a gas turbine engine.

Coating 10 is formed of a matrix material and a filler material, both in powder form. The matrix material may be formed of constituents including, but not limited to: pure metals, alloyed metals, intermetallics, oxide ceramics, glasses, carbides, and nitrides. Examples of suitable metals and alloyed metals include, but are not limited to: nickel, nickel-based alloys, cobalt, cobalt-based alloys, copper, copper-based alloys, nichrome (a nickel-chromium alloy), monel (a copper-nickel alloy), aluminides, aluminum, aluminum-based alloys, and amorphous alloys. The filler material may be formed of constituents including, but not limited to: intermallics, oxide ceramics, glasses, carbides, nitrides, carbon, graphite, organics, polymers, mixed oxides, alumina, titania, zirconia, metal oxide ceramics and mixtures and alloys thereof, bentonite clay, silica, organic binders or fillers, Lucite (poly-methyl-methacrylate), polyester, Teflon (PTFE), polypropylene, polyethylene, low molecular weight polyethylene, high molecular weight polyethylene, and ultra high molecular weight polyethylene. Particular examples of suitable carbides include, but are not limited to: tungsten carbide, chromium carbide, metallic carbides, porous carbides, mixed carbides, and sub-stoichiometric carbides. Coating 10 may also be a carbide "cermet" coating constituting a molten matrix and a substantially solid carbide filler. Examples of carbide "cermet" coatings include, but are not limited to: tungsten carbide and tungsten carbide with a Ni, Ni—Cr, Co, Ni—Co—Cr matrix, or a chromium carbide and chromium carbide with a Ni, Ni—Cr, Co or Ni—Co—Cr matrix.

In an exemplary embodiment, the filler material constitutes between approximately 5% by volume and approximately 75% by volume of coating 10. However, the particular concentrations of the matrix material and the filler material forming coating 10 will depend on the constituents used and the desired properties of coating 10. In an exemplary embodiment, the matrix material is 55% by volume aluminum-silicon alloy having an 88/12 weight percent ratio and the filler material is 45% by volume Lucite. This exemplary embodiment of coating 10 is created by spraying approximately 20% by weight Lucite powder and 80% by weight 88/12 weight percent ratio aluminum-silicon alloy powder onto component 14.

Surface 12 provides a base for coating 10 and may be formed of materials including, but not limited to: titanium alloys, aluminum alloys, steels, stainless steels, nickel alloys, and fiber reinforced composites. Examples of fiber reinforced composites include, but are not limited to: fiberglass, Kevlar, and carbon fiber composites. Depending on the coefficient of thermal expansion of the materials forming coating 10 and the coefficient of thermal expansion of surface 12, the tensile stress of coating 10 may increase or decrease, effecting deflection of component 14. As the difference in the coefficients of thermal expansion increases, the potential for deflection also increases. Thus, in choosing the materials to form coating 10 for a particular surface 12, it may be beneficial to closely match the coefficients of thermal expansion of coating 10 and component 14.

In operation, the powder particles of the matrix material and the filler material of coating 10 are mixed and heated in a spray gun prior to being applied onto surface 12 of component 14. The powder particles are heated while in the spray plume, or a heated gas stream, of a spray torch. The heat is supplied by electric arc (for air plasma or reduced pressure plasma spraying), radio frequency excitation (for RF plasma spraying), or by combustion of a fuel with oxygen (for HVOF or flame spraying). During heating, the matrix material and the filler material are heated to a temperature to form molten droplets such that both the matrix material and the filler material are capable of adhering to surface 12, forming coating 10. Depending on the desired properties of coating 10, the filler material may then be burned out from coating 10 after the powder particles have been deposited onto surface 12 to increase the porosity of coating 10.

As the powder particles are being heated, the matrix material of coating 10 is melted such that it has a molten fraction and a solids fraction. The molten fraction of the matrix material contributes to the tensile stress component of coating 10, while the solids fraction, including solid particles, contributes to the compressive stress component of coating 10. These stresses are balanced by controlling the thermal energy (i.e. heating, melting and superheating of particles/droplets) and kinetic energy of the droplets being sprayed. The deposition process depends on ensuring that the droplets adhere to surface 12. The molten droplets are sprayed at a velocity sufficient to allow the droplets to reach and strike surface 12 with enough kinetic energy to overcome its surface tension and at least slightly flatten and conform to surface 12 before solidifying. In an exemplary embodiment, the droplets are sprayed at a velocity of between approximately 25 meters per second (m/sec) and approximately 50 m/sec. The droplets fuse to surface 12 when the droplets have high levels of super-heating or when surface 12 is sufficiently hot. The deposition of the molten droplets typically results in a coating having high levels of tensile residual stress.

It is generally desirable for solid particles to be ductile to deposit the particles on surface 12. The ductility may either be inherent at room temperature or induced by heating the particles during spraying. Bonding solid ductile particles to surface 12 typically requires a velocity of at least approximately 400 m/sec, depending on factors including, but not limited to: particle size, temperature, and material characteristics. Upon impact with surface 12, the particles deform and kinetic energy is converted into heat. Bonding mechanisms include mechanical interlocking and metallurgical bonding induced by the high temperature and high shear that occurs at the interfaces. Thus, the deposition of solid particles typically results in coatings with high compressive stresses.

To properly bond the droplets to surface 12 to form coating 10, the kinetic energy and thermal energy of the droplets must be balanced. As the thermal energy increases, the molten fraction and tensile stress in coating 10 increases. Decreasing the molten fraction and increasing the kinetic energy increases the compressive stress in coating 10. Coating 10 is a partially molten mixture, requiring an intermediate velocity or kinetic energy. The smaller particles become molten and deposit onto surface 12 easily at lower velocities, while the larger particles become partially molten and require more kinetic energy to bond to surface 12. The larger, partially melted particles will not deform and conform to surface 12 as readily as the smaller, molten droplets will deform and conform to surface 12. Thus, while the kinetic energy must be higher for the droplets of coating 12 to bond to surface 12 than for a completely molten mixture, because coating 10 is a partially molten mixture, less kinetic energy is required to produce a well-bonded, dense coating 10 than is required for bonding completely solid particles to surface 12.

The balance between the thermal energy and kinetic energy is achieved by selecting particular feed stock characteristics, spray equipment, and operating parameters. In an exemplary embodiment, the feed stock powder is 88/12 Al/Si with a particle size range of between approximately 45 microns and approximately 90 microns. Aluminum particles at this size distribution results in the desired molten fraction when subjected to a spray process. The filler material is poly-methylmethacrylate (Lucite), making up approximately 15% by weight of the powder mixture and having a particle size range of between approximately 45 and approximately 125 microns. At this particle size distribution, the Lucite survives the hot spray process and deposits into coating 10, contributing little to the mechanical and stress properties of coating 10.

Conventional industry standard spray equipment is used to spray coating 10 onto surface 12. In an exemplary embodiment, a powder injection and plasma spray torch is used. The standard equipment includes a sound proof enclosure, dust collection and ventilation system, rotary table to which the part is mounted, a robot for torch manipulation, and automated manipulation control and plasma spray parameter control. An important factor in selecting the equipment is selecting a spray torch that is suited to producing the desired particle temperature and velocity. Most conventional plasma spray torches can put too much heat and not enough velocity into the particles. For example, high velocity oxygen-fuel (HVOF) torches have two problems. Some of the HVOF torches spray the particles at too high a velocity, resulting in excessive compressive stress. In addition, most of the HVOF torches expend too much heat into the environment to use with low temperature materials, such as aluminum and Lucite. However, some HVOF torches will work with this application.

In addition, by controlling the temperature and velocity of the droplets as coating 10 is being sprayed, residual stress may be manipulated into tensile, neutral, or compressive regimes. In an exemplary embodiment, the reduced tensile stress of coating 10 results in a 43% reduction in deflection rate compared to coatings of similar thicknesses currently available in the art. The remaining deflection is believed to be caused by mismatches between the coefficients of thermal expansion (CTE) between coating 10 and component 14.

At a given rate of heat input into a powder particle, the temperature of the powder particles increase and the powder particles begin to melt (melting point). If the powder particle is a pure material, the powder particle will stay at the melting point as it absorbs heat to overcome the latent heat of fusion and the molten fraction to solids fraction ratio of the matrix material increases. If the powder particle is an alloy or a multi-phase mixture, the temperature will rise as the molten fraction of the matrix material increases. Thus, if the powder particle is a pure material with a single melting point, the powder particles are heated to the melting point of the powder particle. For an alloy or multi-phase mixture, the powder particles are heated to a temperature between the onset and completion of melting depending on the desired molten fraction of the matrix material. In an exemplary embodiment, when the matrix material is heated to approximately the melting temperature of the matrix material, the matrix material has a molten fraction of between approximately 33% and approximately 90% by volume and a corresponding solids fraction of between approximately 10% and approximately 66% by volume. The matrix material preferably has a molten fraction of between approximately 70% and approximately 80% by volume and a corresponding solids fraction of between approximately 20% and approximately 30% by volume. Obtaining a particular molten fraction for an alloy or multi-phase mixture may be complicated due to the fact that the alloy melts over a range of temperatures. In simple cases, the molten fraction may be linearly proportional to the temperature within the melting temperature range. However, in more complicated cases, other factors that may affect the molten fraction include, but are not limited to: high gradients in the plasma plume, high plasma enthalpy or temperature, the size of the particles, and the flight time. In these cases, the molten fraction will generally depend on the process parameters and the characteristics of the powder particles. The exact material is inconsequential in that if the powder particles are a pure metal or a eutectic alloy, any molten fraction can occur at exactly the melting point.

One method of increasing the predictability of the molten fraction of the powder particles is by using a bimodal particle size distribution consisting of fine particles and coarse particles for one material. For a real bimodal powder size distribution, the finest particles are superheated and the coarsest particles of the fine particle fraction are fully melted at the melting point of the powder particles. Also at the melting point of the powder particles, the finest particles of the coarse fraction are at approximately the melting point, and the coarsest particles are below the melting point. Thus, the fine particles form the molten fraction and the coarse particles form the solids fraction. The more coarse particles form the solids fraction because as the particles increase in size, the less they will melt. This is due to the fact that the absorbed energy will first go into heating the particle before actually melting the particle. Thus, the fine particles will melt first, creating the molten fraction. In an exemplary embodiment, the fine particles have a diameter of less than approximately 45 microns and the coarse particles have a diameter of greater than approximately 75 microns for a loading of between approximately 33% and approximately 90% by weight fine particles and between approximately 10% and approximately 66% by weight coarse particles. As an example, for a eutectic aluminum-silicon alloy having an 88/12 weight percent ratio, the particle powders are heated to a temperature of approximately 577° C. (1071° F.), the melting point of the alloy, to achieve a molten fraction of between approximately 33% and approximately 90% by volume. Once the matrix material and the filler material are heated, they form a molten mixture.

After the matrix material and filler material have been heated to form the molten mixture, the molten mixture is sprayed at the elevated temperature towards surface 12 and deposited onto surface 12 as droplets. Once the molten mixture has been deposited onto surface 12, the molten mixture cools down to form coating 10. As the molten mixture cools down to the temperature of surface 12 of component 14, the particles in the molten mixture solidify and shrink, causing tensile stress in coating 10. Additional tensile stress may be added to coating 10 due to the difference in thermal expansion coefficient between the molten mixture and component 14. In addition, the tensile stress is further increased because the molten mixture is applied at an elevated temperature. In one exemplary embodiment, coating 10 is applied onto surface 12 to a thickness of between approximately 0.015 inches and approximately 0.28 inches and preferably to a thickness of between approximately 0.15 inches and approximately 0.28 inches. In another exemplary embodiment, coating 10 is applied onto surface 12 to a thickness of between approximately 0.28 inches and approximately 0.75 inches.

Coating 10 may be applied onto surface 12 by any means known in the art, including, but not limited to: plasma spraying and HVOF spraying. When coating 10 is applied by plasma spraying, the molten mixture is sprayed onto component 14 at a velocity of between approximately 150 meters per second and approximately 300 meters per second. In an exemplary embodiment, a Progressive Technologies 100HE torch is used to apply coating 10. The Progressive Technologies 100HE torch is suited to producing a higher velocity spray than conventional plasma torches and a lower velocity spray than HVOF spraying while not excessively heating and melting the particles. The Progressive Technologies 100HE torch is well-suited to achieving the desired amount of particle melting and velocity due to its arc stability and operating range, fitting into the middle ground between high temperature plasma torches and high velocity HVOF torches. The Progressive Technologies 100HE torch heats the plasma gas by electric arc similar to other plasma torches, except that the internal geometries and the gas flow rates used in the Progressive Technologies 100HE force the arc to stretch out to approximately three inches in length, then attach to arc retainer rings at the down stream end of the arc. This is desirable because the length of the arc and resultant plasma temperature and velocity is much more stable and uniform than conventional torches. Additionally, the combination of nozzle geometry and high gas flow rates result in the desired velocity and heat input to the particles to produce coating 10. These conditions exist in the normal operating range for the torch such that the process is stable and does not wear out the components of the torch quickly. The Progressive Technologies 100HE torch is designed thus to be durable and stable at the particular velocities and temperatures required to spray coating 10 without being pushed outside of its normal operation range. For example, coating 10 is sprayed with the Progressive Technologies 100HE using a ternary gas mixture of nitrogen, argon, and hydrogen at an approximately 50 kilo-Watt (kW) to approximately 100 kW power level and powder feed. The powder is fed into the spray torch at a rate of between approximately 100 grams per minute (g/min) and approximately 600 g/min. In an exemplary embodiment, coating 10 is deposited at a thickness of between approximately 0.0001 inches to approximately 0.01 inches per axial pass. Preferably, coating 10 is deposited at a thickness of between approximately 0.0005 inches to approximately 0.0015 inches per axial pass.

Although coating 10 is discussed as being mixed, heated, and then applied as a molten mixture, coating 10 may be applied onto surface 12 by any means known in the art. Examples include, but are not limited to: a composite powder in which each powder particle contains all constituents; a blended powder in which two or more powder particles are blended and fed through a single port or multiple powder feed ports of a spray torch; separate feeds that are merged into a single flow prior to reaching the powder port of a spray torch; separate feeds that remain separate through the powder ports of a spray torch and become mixed in the spray plume or on surface 12, and completely separate spray systems using two separate spray torches that deposit sparse, thin layers of the matrix material and the filler material that become mixed as the layers build up on each other on surface 12.

Figure 2:
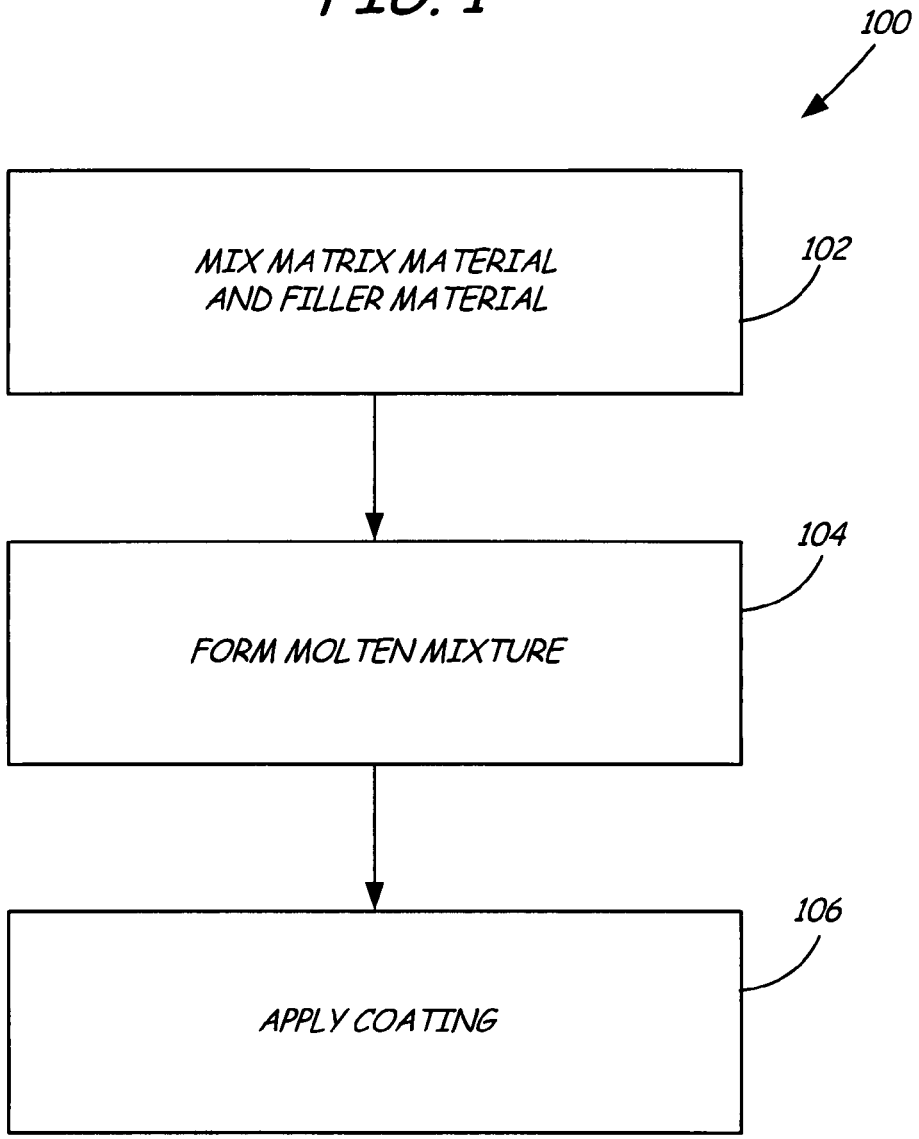
FIG. 2 is a diagram of a method of applying the coating onto the component.

FIG. 2 shows a diagram of a method 100 of applying coating 10 onto surface 12 of component 14. The matrix material and filler material forming coating 10 are first mixed together, Box 102. In exemplary embodiment, the filler material constitutes between approximately 5% by volume and approximately 75% by volume of coating 10. The matrix material and filler material are then heated to approximately a melting temperature of the matrix material to form a molten mixture, Box 104. In an exemplary embodiment, the matrix material is melted to have a molten fraction of between approximately 33% and approximately 90% by volume. As can be seen in Box 106, the molten mixture is then directed towards surface 12 of component 14 at a velocity sufficient to adhere the molten mixture onto surface 12 and form coating 10. In an exemplary embodiment, the molten mixture is directed towards surface 12 at a velocity of between approximately 150 meters per second and approximately 300 meters per second. As an optional step, after the molten mixture has been applied onto surface 12, the filler material in coating 10 may be burned off to create porosity within coating 10. Although method 100 is discussed as mixing and heating the matrix material and the filler material to form a molten mixture prior to depositing the molten mixture on surface 12, the matrix material and the filler material may alternatively be deposited onto surface 12 separately.

The reduced tensile stress coating is formed of a matrix material and a filler material. After the matrix material and filler material have been mixed, they are heated to form a molten mixture which is directed towards a surface of a component. At the elevated temperature, the matrix material has a molten fraction of between approximately 33% and approximately 90% by volume. Using a bimodal powder size distribution may also increase the predictability of the molten fraction of the matrix material. With proper spray parameter selection, the coating is applied onto the component having substantially no spray-related tensile and compressive stresses. The reduced tensile stress in the coating is achieved by balancing the thermal and kinetic energy of the coating as it is being sprayed onto the surface of the component. The coating may be applied onto gas turbine engine components, such as an abradable outer air seal.

Although the present invention has been described with reference to preferred embodiments, workers skilled in the art will recognize that changes may be made in form and detail without departing from the spirit and scope of the invention.

The invention claimed is:

1. A composition for deposition as a coating, the composition comprising:

a metal matrix material in powder form having a bimodal particle size distribution and having a molten fraction of between about 33% and about 90% by volume at about a melting temperature of the matrix material; and a filler material in powder form;

wherein the metal matrix material and the filler material form a thermal spray coating material that contains partially molten metal during deposition and forms a metal matrix composite when deposited with the filler material interspersed in the metal matrix.

2. The composition of claim 1, wherein the matrix material has a molten fraction of between about 70% and about 80% by volume at about a melting point of the matrix material.

3. The composition of claim 1, wherein the matrix material is selected from the group consisting of: pure metals, alloyed metals, and intermetallics.

4. The composition of claim 1, wherein the filler material is selected from the group consisting of: intermetallics, oxide ceramics, glasses, carbides, nitrides, carbon, graphite, organics, polymers, mixed oxides, alumina, titania, zirconia, metal oxide ceramics and mixtures and alloys thereof, bentonite clay, silica, organic binders or fillers, poly-methyl-methyacrylate, polyester, Teflon (PTFE), polypropylene, polyethylene, low molecular weight polyethylene, high molecular weight polyethylene, and ultra high molecular weight polyethylene.

5. The composition of claim 1, wherein the filler material constitutes between about 5% and about 75% of the composition by volume.

6. The composition of claim 5, wherein the filler material constitutes about 50% of the composition by volume.

7. A component having a low tensile stress coating, the component comprising:

a substrate; and a thermal spray coating of a metal matrix having a bimodal particle size distribution with a filler material dispersed in the metal matrix on the substrate;

wherein when the thermal spray coating is being applied to the substrate, the metal matrix material has a molten fraction of between about 33% and about 90% by volume at about a melting point of the matrix material.

8. The component of claim 7, wherein the matrix material has a molten fraction of between about 70% and about 80% by volume at about a melting point of the matrix material.

9. The component of claim 7, wherein the filler material constitutes between about 5% and about 75% by volume of the coating.

10. The component of claim 7, wherein the matrix material is selected from the group consisting of: pure metals, alloyed metals, and intermetallics.

11. The component of claim 7, wherein the filler material is selected from the group consisting of: intermetallics, oxide ceramics, glasses, carbides, nitrides, carbon, graphite, organics, polymers, mixed oxides, alumina, titania, zirconia, metal oxide ceramics and mixtures and alloys thereof, bentonite clay, silica, organic binders or fillers, poly-methyl-methyacrylate, polyester, Teflon (PTFE), polypropylene, polyethylene, low molecular weight polyethylene, high molecular weight polyethylene, and ultra high molecular weight polyethylene.

12. The component of claim 7, wherein the coating is between about 0.15 inches thick and about 0.75 inches thick.

13. The component of claim 12, wherein the coating is between about 0.15 inches thick and about 0.28 inches thick.

* * * * *